US007029000B2

(12) United States Patent
Petit et al.

(10) Patent No.: US 7,029,000 B2
(45) Date of Patent: Apr. 18, 2006

(54) SEALED LOCKING PIN LOCATOR CLAMP

(75) Inventors: Brian D. Petit, Algonac, MI (US); Edwin G. Sawdon, St. Clair, MI (US)

(73) Assignee: BTM Corporation, Marysville, MI (US)

( * ) Notice: Subject to any disclaimer, the term of this patent is extended or adjusted under 35 U.S.C. 154(b) by 0 days.

(21) Appl. No.: 10/935,700

(22) Filed: Sep. 7, 2004

(65) Prior Publication Data

US 2006/0049565 A1 Mar. 9, 2006

(51) Int. Cl.
*B23Q 1/00* (2006.01)

(52) U.S. Cl. ..... 269/47; 269/32; 269/49

(58) Field of Classification Search ..... 269/47, 269/24, 32, 91–95, 228, 237, 244, 27
See application file for complete search history.

(56) References Cited

U.S. PATENT DOCUMENTS 5,165,670 A 11/1992 Sawdon
5,190,334 A 3/1993 Sawdon
5,853,211 A 12/1998 Sawdon et al.
5,871,250 A 2/1999 Sawdon
5,884,903 A 3/1999 Sawdon
6,364,300 B1 * 4/2002 Kita ..... 269/32
6,378,855 B1 * 4/2002 Sawdon et al. ..... 269/32
6,439,560 B1 * 8/2002 Sawada et al. ..... 269/32
6,502,880 B1 1/2003 Sawdon
6,786,478 B1 * 9/2004 Pavlik et al. ..... 269/49
6,902,159 B1 * 6/2005 Sawdon et al. ..... 269/32
2005/0040578 A1 * 2/2005 Sawdon et al. ..... 269/32

* cited by examiner

*Primary Examiner*—Lee D. Wilson
(74) *Attorney, Agent, or Firm*—Harness, Dickey & Pierce P.L.C.

(57) ABSTRACT

A clamp and method for locating a clamping workpiece in predetermined location are disclosed. The clamp includes a clamp body, a driving member, a workpiece-locating pin and a clamping member. The driving member is moveable in a first linear direction at least partially inside the clamp body. The workpiece-locating pin is moveable in a second direction substantially perpendicular to the first direction and at least partially externally projects from the body. The clamping member is moveable relative to the workpiece-locating pin in the first direction when moving between a retracted position and a clamping position.

26 Claims, 10 Drawing Sheets

SEALED LOCKING PIN LOCATOR CLAMP

BACKGROUND AND SUMMARY OF THE INVENTION

The present invention relates generally to a clamp and more specifically to a sealed locking pin locator clamp.

Automated or powered clamps have been used to secure workpieces, such as sheet metal automotive vehicle body panels, polymeric parts and the like in checking fixtures, gauging stations, molding stations and punching machines. Some existing clamps are powered by hydraulic or pneumatic fluid pressure. For example, reference should be made to the following U.S. patents, which have been invented by Sawdon: U.S. Pat. No. 5,884,903 entitled "Powered Clamp Gauging Apparatus" which issued on Mar. 23, 1999; U.S. Pat. No. 5,165,670 entitled "Retracting Power Clamp" which issued on Nov. 24, 1992; U.S. Pat. No. 5,190,334 entitled "Powered Clamp with Parallel Jaws" which issued on Mar. 2, 1993; and U.S. Pat. No. 6,378,855 entitled "Locking Pin Clamp" which issued on Apr. 30, 2002; all of which are incorporated by reference herein.

It has also become desirable to prevent the gripping arm from opening and releasing the workpiece if there is a loss of fluid pressure. Gripper constructions employing such a feature are disclosed in U.S. Pat. No. 5,871,250 entitled "Sealed Straight Line Gripper" which issued to Sawdon on Feb. 16, 1999, and U.S. Pat. No. 5,853,211 entitled "Universal Gripper" which issued to Sawdon et al. on Dec. 29, 1998. These patents are also incorporated by reference herein.

In accordance with the present invention, a preferred embodiment of a sealed locking pin locator clamp employs a piston head operably advancing in a first linear direction, a clamp body, a driving member coupled to the piston head, a workpiece-locating pin movably coupled to the driving member and a clamping member movably coupled to the driving member. The driving member is moveable in a first direction in concert with the piston head. The driving member is moveable at least partially inside of the body. The workpiece-locating pin is moveable in a second direction substantially perpendicular to the first direction. The workpiece-locating pin at least partially externally projects from the body. The clamping member is moveable relative to the workpiece-locating pin in the first direction when moving from a retracted position to a clamping position.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
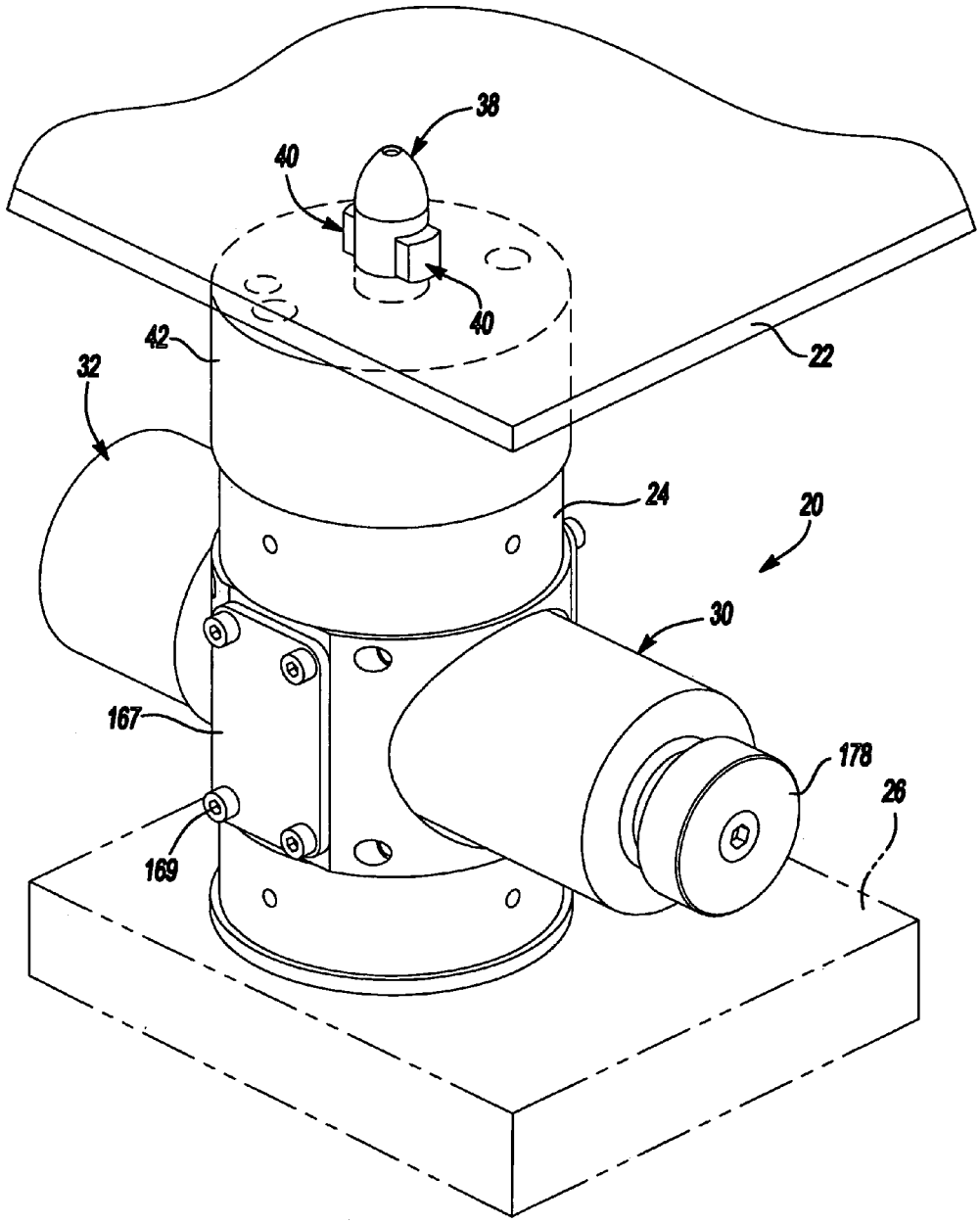
FIG. 1 is a perspective view showing a first embodiment sealed locking pin locator clamp with a pair of clamping members shown in a clamping position.
Figure 2:
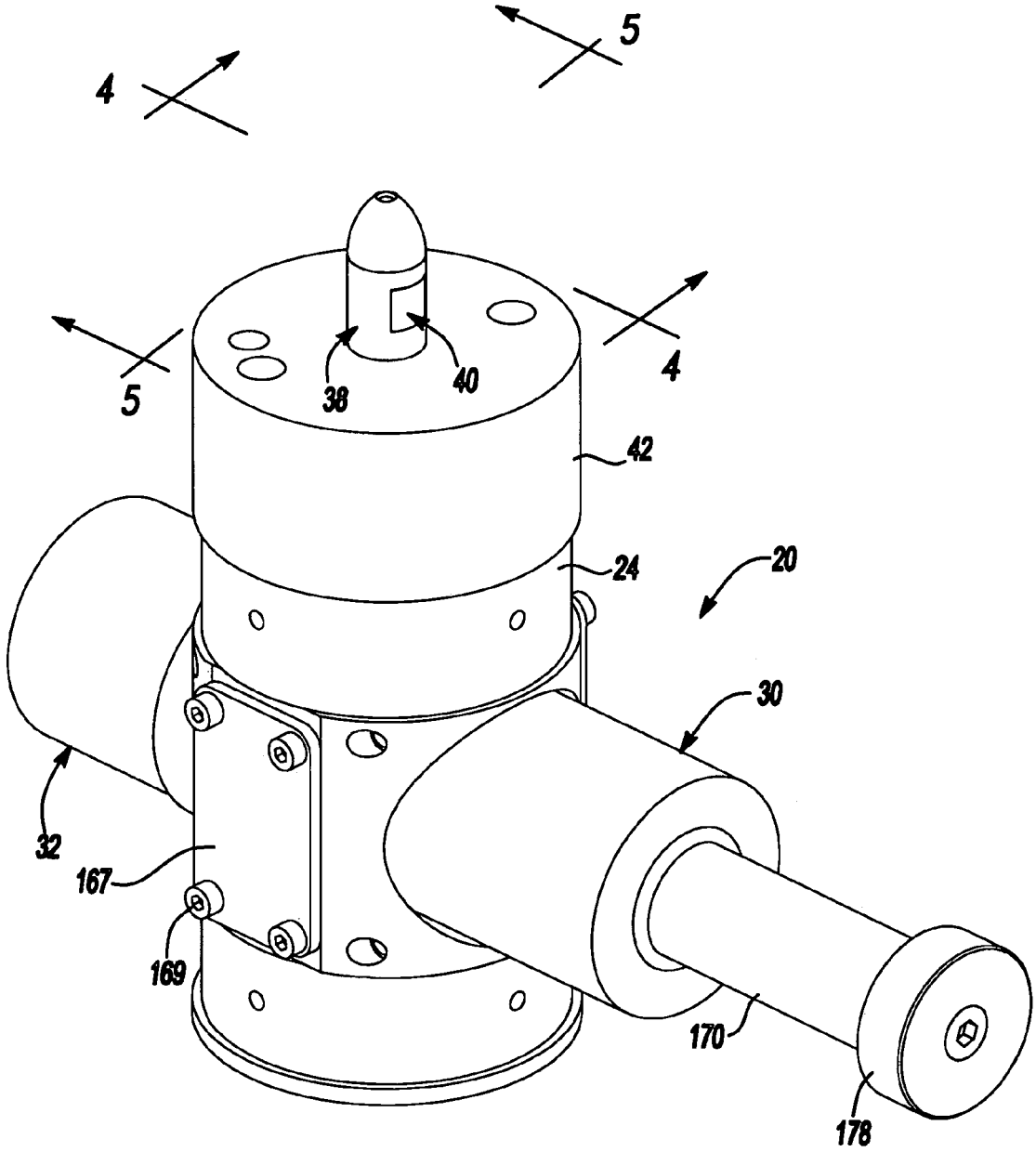
FIG. 2 is a perspective view of the first embodiment sealed locking pin locator clamp showing the clamping members in a retracted position.
Figure 3:
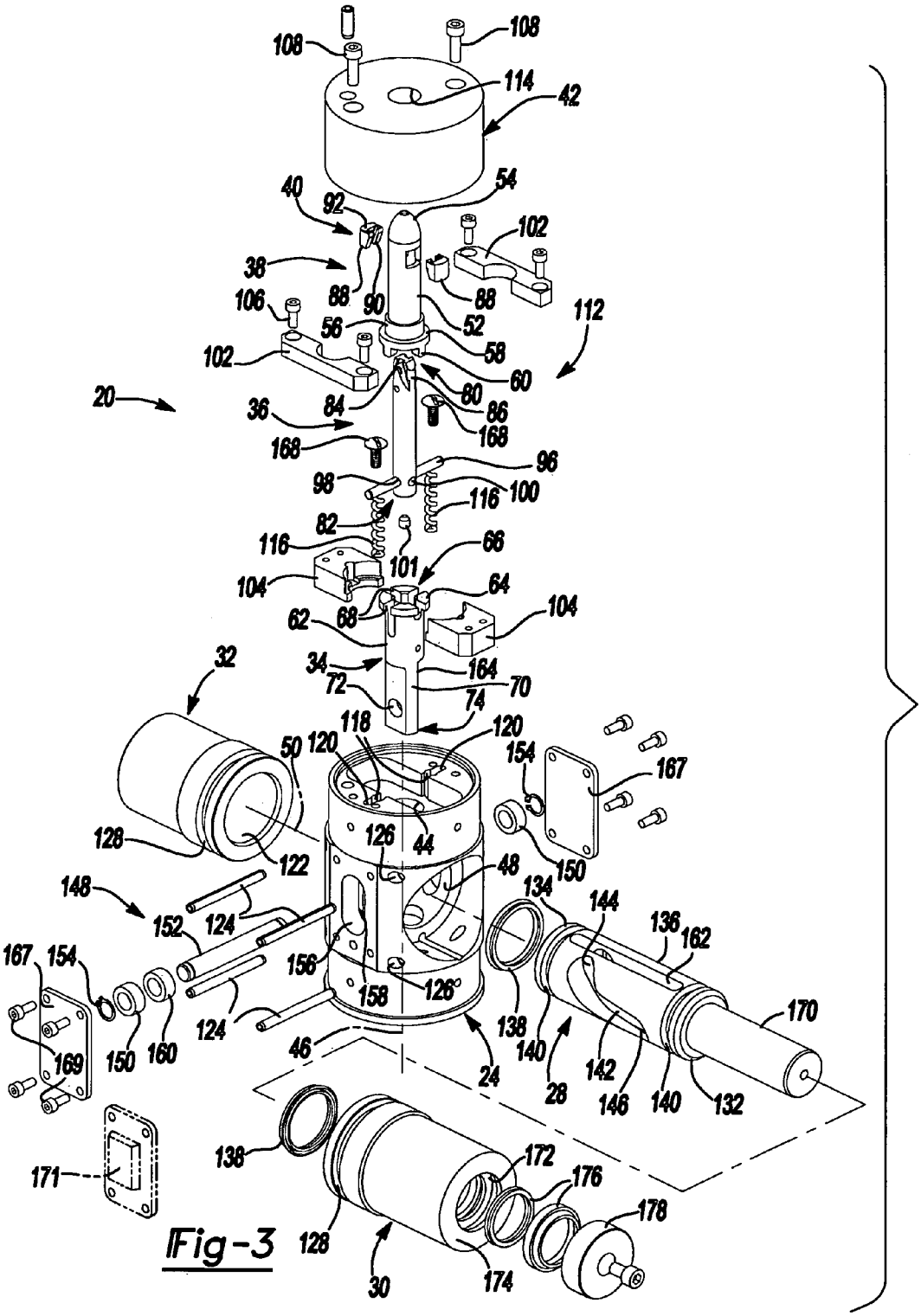
FIG. 3 is an exploded perspective view showing the first embodiment sealed locking pin locator clamp.

The following description of the preferred embodiment(s) is merely exemplary in nature and is in no way intended to limit the invention, its application, or uses.

Referring to FIGS. 1–9, a first preferred embodiment of a sealed locking pin locator clamp 20 of the present invention is used to locate or gauge and then clamp a workpiece 22. A clamp body 24 may be fixed to a stationary mount or table 26 by way of threaded screws and/or dowels (not shown). Alternatively, clamp body 24 may be secured to an end effector (not shown) of a robotic arm. Thus, workpiece 22 may be moved relative to the stationary mounted clamp 20 or clamp 20 may be moved relative to a stationarily mounted workpiece 22.

Clamp 20 includes a piston 28, a first piston cylinder 30, a second piston cylinder 32, a piston rod 34, a control member 36, a locating pin 38, a pair of clamping members 40, and a collar 42. Clamp body 24 includes a first longitudinally elongated internal bore 44 having a central axis 46 and a second transversely elongated internal bore 48 having a central axis 50.

Locating pin 38 is a substantially cylindrically shaped hollow member having an outer cylindrical surface 52 at its midsection, an arcuate taper 54 and at a distal end, a first shoulder 56 and a second shoulder 58 at its proximal end. A pair of ribs 60 axially extend from second shoulder 58. The preferred embodiment includes bore ribs 60 circumferentially spaced apart from one another at ninety-degree intervals.

Piston rod 34 includes a substantially cylindrical body 62 having a circular flange 64 positioned at a distal end 66. A pair of perpendicularly oriented slots 68 extend through circular flange 64 and a portion of body 62. Slots 68 are sized and positioned to receive ribs 60 of locating pin 38. Piston rod 34 also includes a unitary working portion 70 that contains an aperture 72 adjacent a proximal end 74. Locating pin 38 and piston rod 34 are slidably positioned within clamp body 24 and are moveable along central axis 46.

A blind bore 76 of locating pin 38 and slotted circular flange 64 of piston rod 34 define a cavity 78 in which control member 36 is slidably positioned. Control member 36 is substantially cylindrically shaped and includes a distal end 80 and a proximal end 82. Two pair of camming surfaces 84 are formed on distal end 80. A pair of generally "T" shaped rails 86 are spaced apart from camming surfaces 84. Rails 86 are shaped to guide and retain clamping members 40. Specifically, each clamping member 40 includes a clamping surface 88, a pair of camming surfaces 90 and a slot 92 sized and shaped to receive one of rails 86. Each clamping member 40 is slidably positioned within a window transversely extending through locating pin 38. Clamping members 40 and control member 36 are sized and shaped such that relative movement between control member 36 and locating pin 38 causes clamping members 40 to move between extended and retracted positions. Workpiece 22 is operably clamped between clamping members 40 and a collar 42.

A cross rod 96 transversely extends through an aperture 98 extending through control member 36. Another aperture 100 extends through proximal end 82 in a direction orthogonal to aperture 98. The rotational orientation of clamping members 40 relative to clamp body 24 may be varied by ninety degrees if alternate aperture 100 is used to house cross rod 96. A screw 101 couples cross rod 96 to control member 36.

A pair of upper keepers 102 are positioned around first shoulder 56 and are coupled to a pair of lower keepers 104 to rigidly interconnect locating pin 38 and piston rod 34. Furthermore, control member 36 is trapped within cavity 78 but free to translate a predefined linear stroke. Cap screws 106 couple upper keepers 102 to lower keepers 104. It should be appreciated that each of the lower keepers 104 are spaced apart from one another to allow cross rod 96 to travel therebetween during clamp operation.

Collar 42 is coupled to clamp body 24 by threaded fasteners 108. Collar 42 and clamp body 24 define a cavity 110. A subassembly 112 including locating pin 38, control member 36, piston rod 34, upper keepers 102 and lower keepers 104 is at least partially slidably positioned within first bore 44 and cavity 110. A portion of locating pin 38 extends through an aperture 114 extending through collar 42.

A pair of springs 116 are positioned within spring seats 118 formed within clamp body 24. Slots 120 axially extend through clamp body 24 and are positioned adjacent to spring seats 118 to allow cross rod 96 to travel freely therein.

First piston cylinder 30 and second piston cylinder 32 are attached to clamp body 24. Each piston cylinder has an internal chamber accessible to second bore 48 and they are elongated coaxially with axis 50. An open end 122 of each piston cylinder is inserted into second bore 48 and secured in its respective fully installed position relative to body 24 by way of a pair of circumferentially compressible roll pins 124. Ends of each roll pin are stationarily secured in openings 126 in clamp body 24 while a middle portion of each roll pin 124 engages a circular groove 128 machined in each piston cylinder. Accordingly, each of the first and second piston cylinders 30 and 32 may be rotated 360 degrees relative to clamp body 24 on axis 50, even after being fully inserted and attached to the clamp body. This feature allows fluid carrying tubes, hoses, and fittings which may be attached to an inlet 130 to be repositioned free of any obstructions in the factory or to improve tube routing by minimizing bends.

Piston 28 is configured to have a pair of opposed piston head portions 132 and 134 and a driving or camming member 136 mounted therebetween. Piston 28 is movably located inside second bore 48, first piston cylinder 30 and second piston cylinder 32. An elastomeric O-ring or other shaped seal 138 is secured within a groove 140 in each piston head portion 132 and 134. A camming slot 142 is internally located in camming member 136 of piston 28. Camming slot 142 preferably has a closed loop configuration defined by a first elongated segment 144 elongated in generally the same direction as axis 50. Axis 50 also defines the advancing and retracting direction of piston 28 within second bore 48. More specifically, an elongated axis of first segment 144 is approximately offset nine degrees from axis 50. Camming slot 142 further includes a second camming segment 146 angularly offset from first segment 144.

A pin assembly 148 is secured to proximal end 74 of piston rod 34. Pin assembly 148 includes a pair of outboard rollers 150 which are rotatably coupled to a central elongated pivot pin 152 by way of snap rings 154. Outboard rollers 150 longitudinally travel within longitudinally elongated slots 156 machined within clamp body 24. Outboard rollers 150 are maintained in their outboard positions by an inward flange 158 offset from each longitudinally elongated slot 156.

A middle roller 160 is journaled around an intermediate portion of pivot pin 152 and lies within a camming slot 162 of piston 28. Middle roller 160 is laterally trapped between a lateral face 164 of working portion 70 and an inwardly stepped face 166 of driving member 136. Pivot pin 152 is rotatably secured within aperture 72 of piston rod 34. Camming slot 142 and pin assembly 148 define a camming mechanism. Plates 167 are coupled to body 24 with fasteners 169 to sealingly cover slots 156. In an alternate embodiment shown in FIG. 3, a proximity switch 171 may be coupled to body 24 in place of plate 167 to sense the position of piston 28.

Clamp body 24, first piston cylinder 30 and second piston cylinder 32 are preferably machined on a lathe from aluminum bar stock having a circular cross-sectional shape. As such, the outer and inner surfaces of these parts predominantly have circular-cylindrical shapes with secondary holes in the slots machined therein. Piston 28, locating pin 38, collar 42, piston rod 34 and control member 36 are preferably machined on a lathe from steel bar stock having a circular cross-sectional shape with other grooves and holes being machined thereafter. Clamping members 40 are either cast or machined from steel components.

Figure 10:
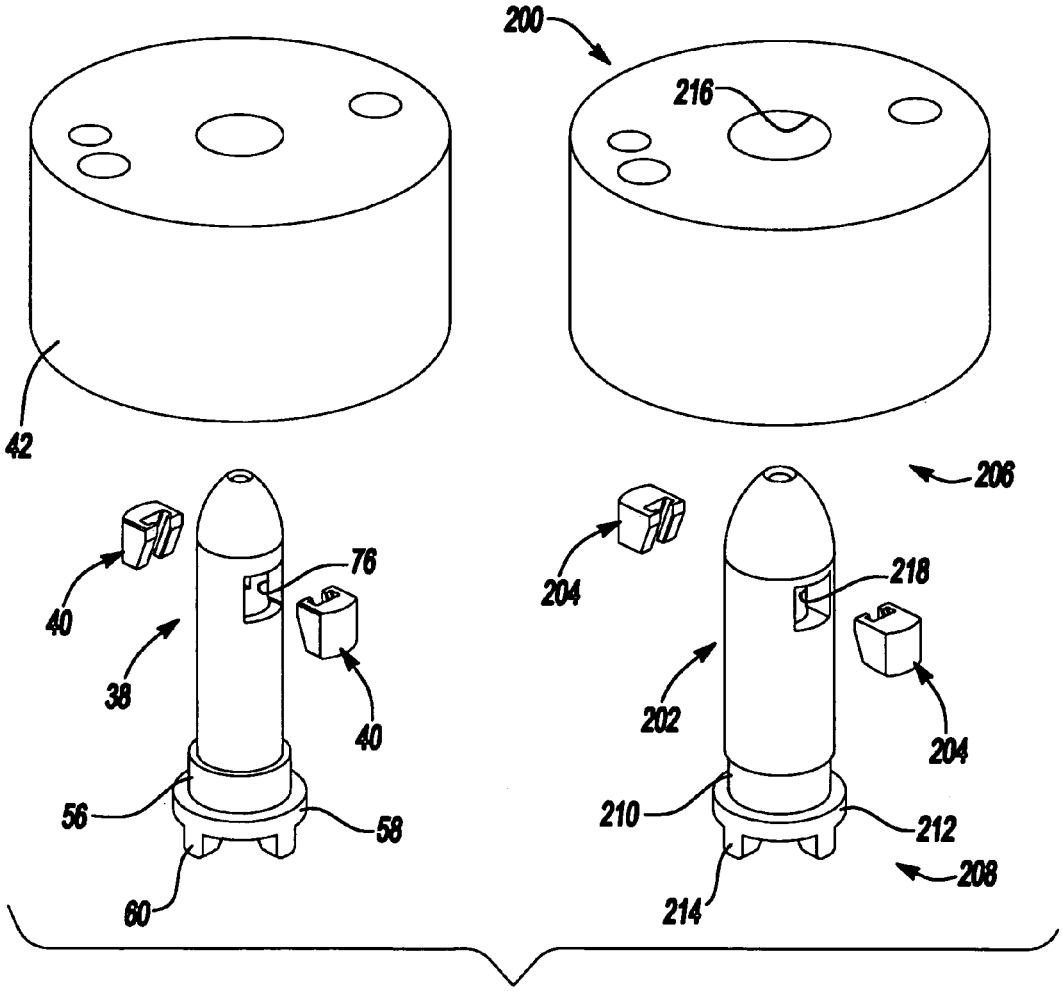
FIG. 10 is an exploded perspective view showing a first embodiment collar, locating pin and clamping member subassembly as well as a second embodiment collar, locating pin and clamping member subassembly.

FIG. 10 depicts collar 42, locating pin 38 and clamping members 40 from first embodiment clamp 20 previously described. Also depicted in FIG. 10 are a second embodiment collar 200, a locating pin 202 and clamping members 204. Collar 200, locating pin 202 and clamping members 204 define a replacement set of components 206 which may replace collar 42, locating pin 38 and clamping members 40 as a group to define a second embodiment clamp assembly. A proximal end 208 of locating pin 202 is substantially similar to the proximal end of locating pin 38. Specifically, the outer diameter of first shoulder 56 is the same size as the outer diameter of a first shoulder 210 of locating pin 202. In similar fashion, the dimensions associated with second shoulder 58 in ribs 60 are equivalent to the shape and dimensions of a second shoulder 212 and ribs 214 of second embodiment locating pin 202. In this manner, locating pin 202 mates with piston rod 34, upper keepers 102 and lower keepers 104 in the manner previously described. Collar 200 includes an aperture 216 sized to receive the increased outer diameter of locating pin 202. Replacement set 206 is shown to include a locating pin 202 having an outer diameter approximately twice the size of locating pin 38. One skilled in the art will appreciate that this size ratio is merely exemplary and that a family of replacement sets may be constructed to allow a user of the sealed locking pin locator clamp to quickly change the size of the locating pin if the workpiece to be clamped so requires. In the manufacturing environment, it is beneficial to be able to quickly change the clamping tooling to provide flexibility for clamping a number of different workpieces having differently sized apertures extending therethrough. Locating pin 202 includes a blind bore 218 similarly sized to blind bore 76 to accommodate common control member 36.

Figure 4:
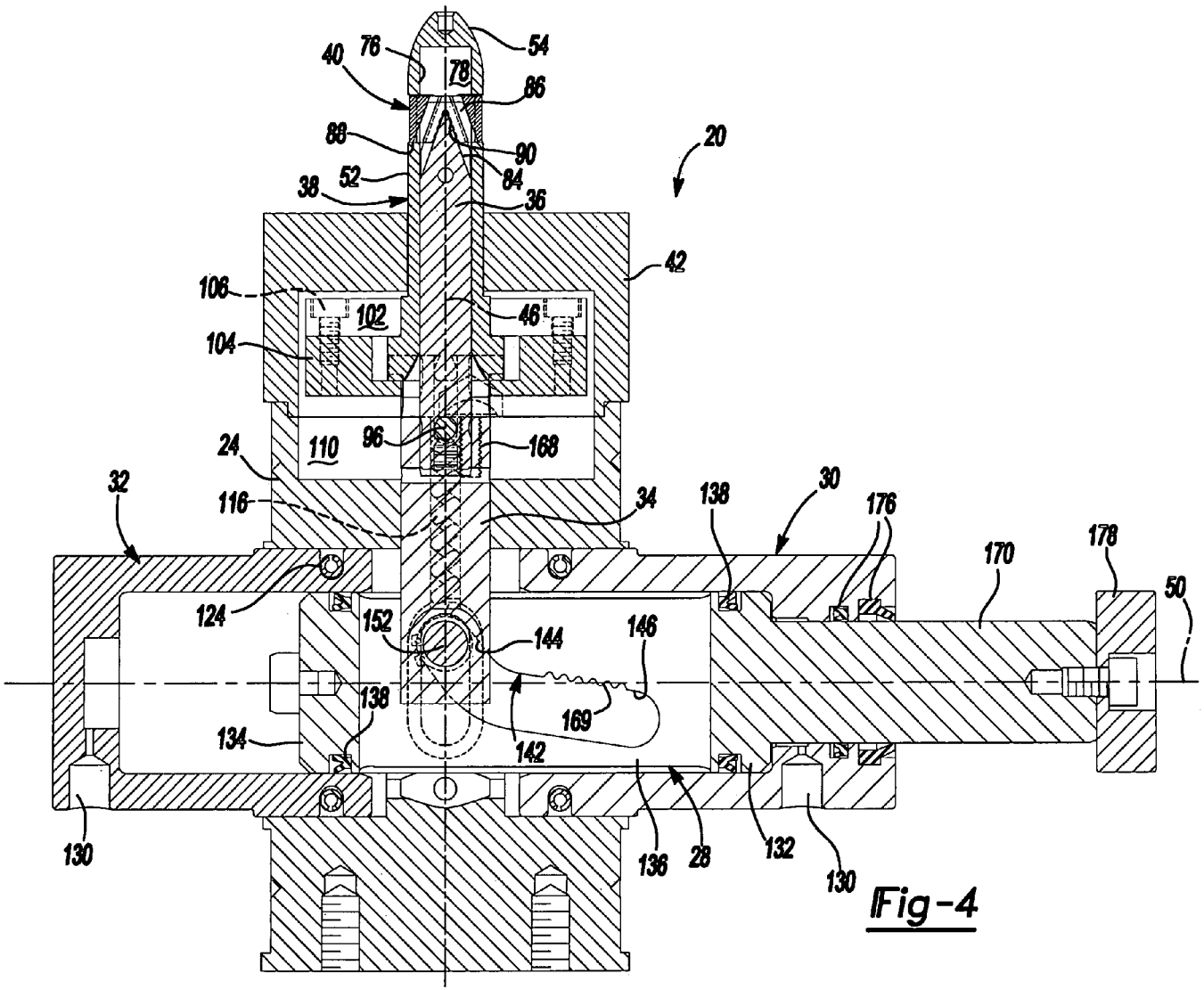
FIG. 4 is a cross-sectional view, taken along line 4—4 of FIG. 2, showing the first embodiment sealed locking pin locator clamp in an unclamped position.
Figure 5:
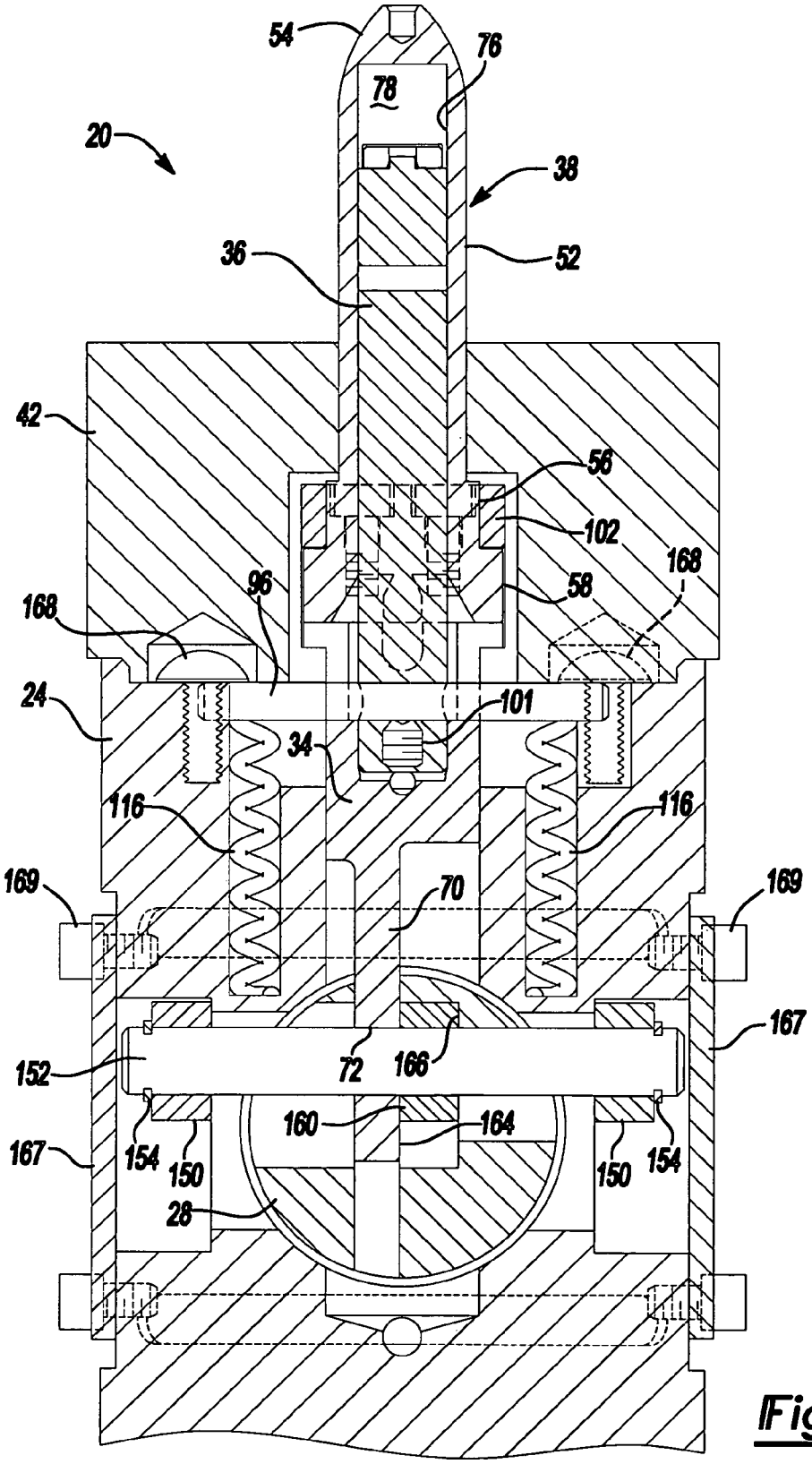
FIG. 5 is a cross-sectional view, taken along line 5—5 of FIG. 2, showing the first embodiment sealed locking pin locator clamp in the unclamped position.
Figure 6:
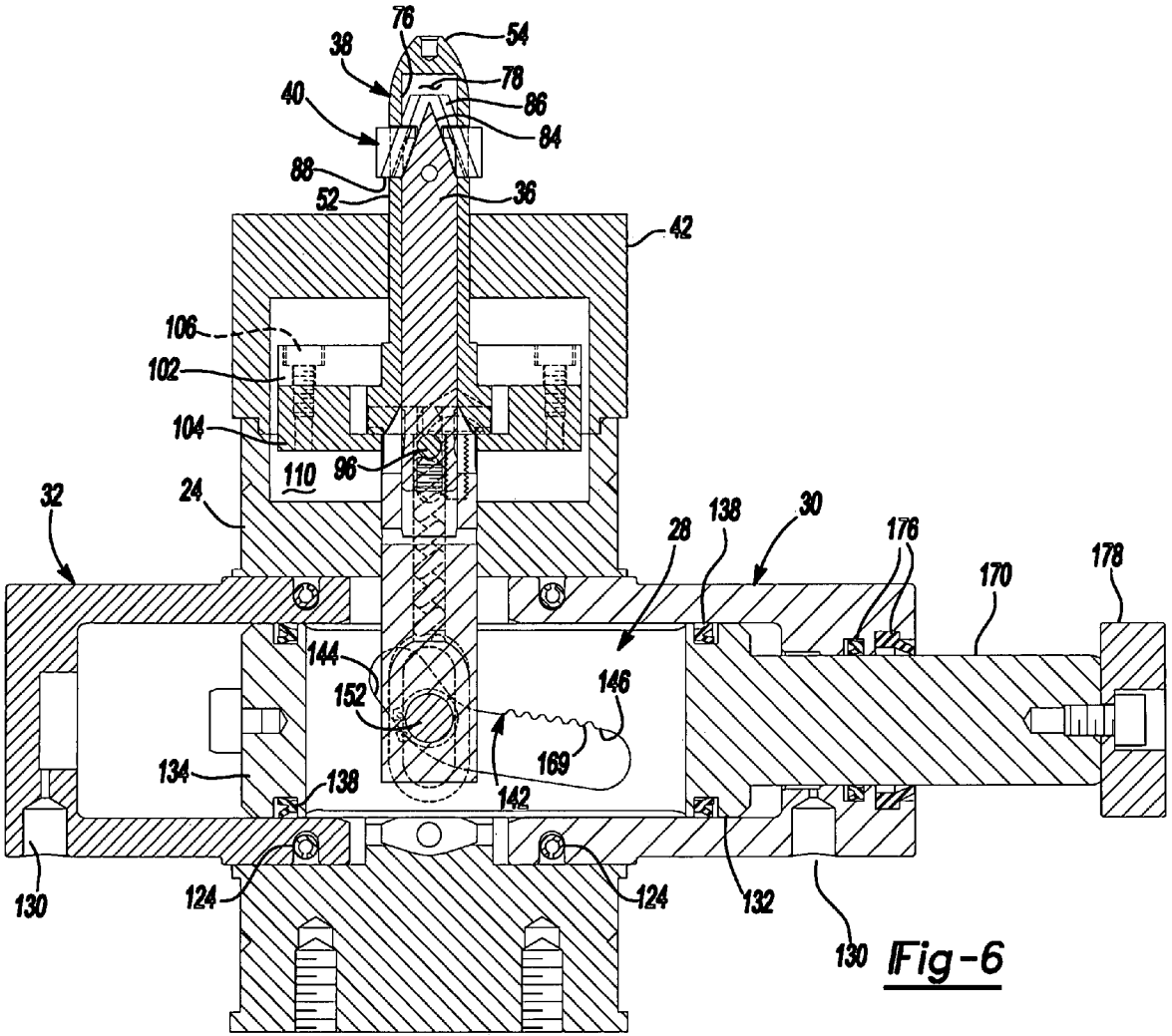
FIG. 6 is a cross-sectional view, like that of FIG. 4, showing the clamp in an intermediate position between the unclamped and clamped positions.
Figure 7:
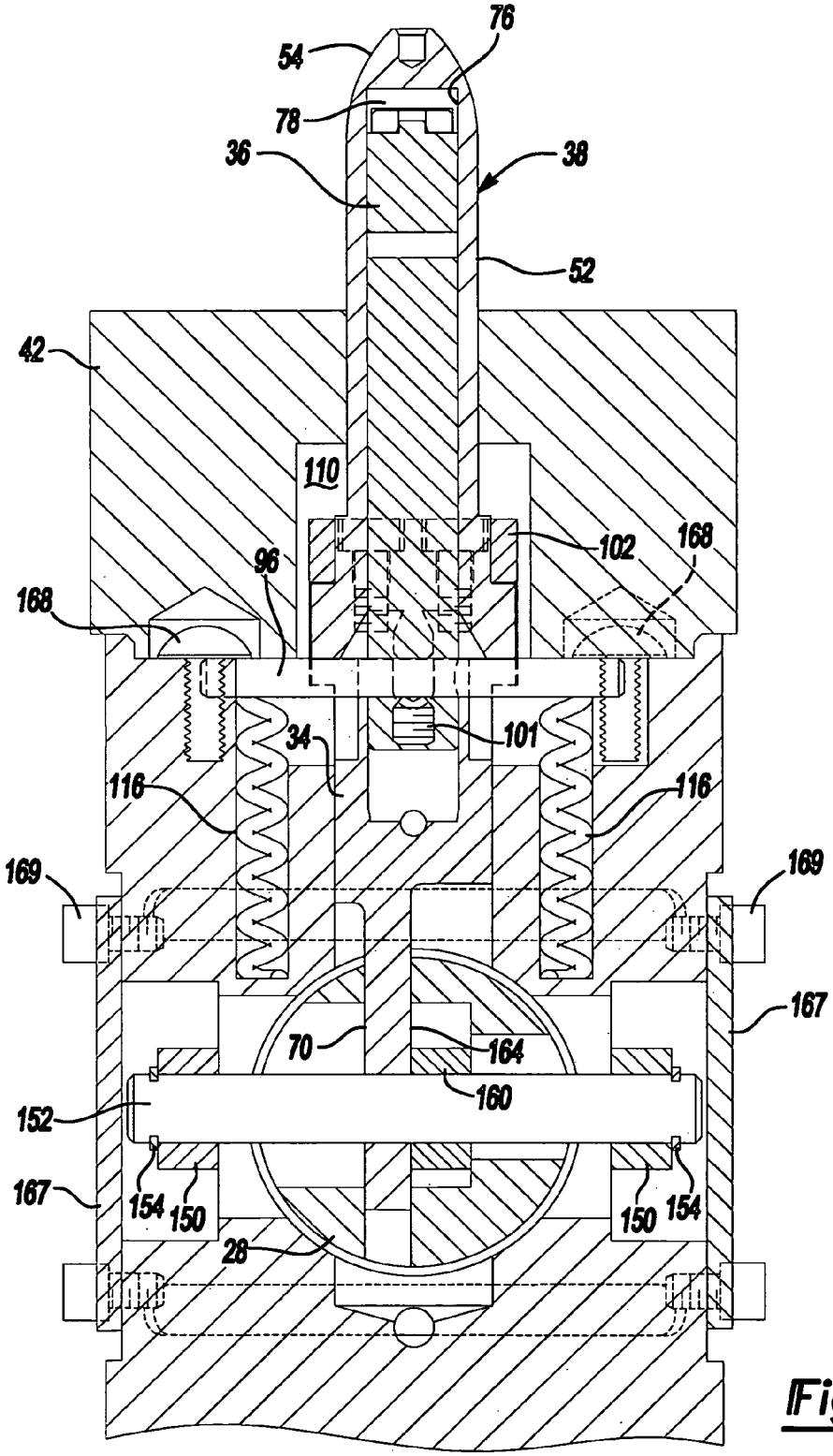
FIG. 7 is a cross-sectional view, like that of FIG. 5, showing the first embodiment sealed locking pin locator clamp in the intermediate position of FIG. 6.

The operation of the first embodiment sealed locking pin locator clamp 20 of the present invention may be observed with reference to FIGS. 4–9. When a pressurized fluid is applied against piston head portion 132, piston 28 is advanced in a first direction along axis 50. This action begins to move clamping members 40 from their fully retracted positions within the internal cavity of locating pin 38, as shown in FIG. 4, to an extended position as shown in FIG. 6. This initial advancing movement from FIGS. 4 and 5 to FIGS. 5 and 6 is achieved by sliding pin assembly 148 down the steeply inclined leading segment of camming slot 142. Pivot pin 152 drives piston rod 34 and locating pin 38 downwardly. At this time, control member 36 is biased toward an upward most position in relation to the Figures by springs 116. Relative motion occurs between locating pin 38 and control member 36 in the form of control member 36 further entering blind bore 76. Camming surfaces 84 of control member 36 engage camming surfaces 90 of clamping members 40 thereby driving the clamping members from their retracted position to the extended position depicted in FIG. 6. During the remaining stroke of piston 28, clamping members 40 remain in the fully extended position.

Further advancement of piston 28 causes pin assembly 148 to ride along second camming segment 146. This portion of piston advancement is depicted as movement between the intermediate position depicted in FIGS. 6 and 7 to the clamped position shown in FIGS. 8 and 9. During this portion of piston movement, middle roller 160 engages second camming segment 146. Also, cross rod 96 is moved from its seat against a pair of screws 168 that are coupled to clamp body 24. Specifically, two ribs 60 of locating pin 38 engage cross rod 96 as locating pin 38 is being driven further downwardly by piston rod 34 and pin assembly 148. Springs 116 are compressed while locating pin 38, control member 36, piston rod 34 and clamping members 40 are translated as a unit. Accordingly, clamping surfaces 88 of clamping members 40 are drawn into contact with workpiece 22 to clamp the workpiece between clamping members 40 and collar 42.

Figure 8:
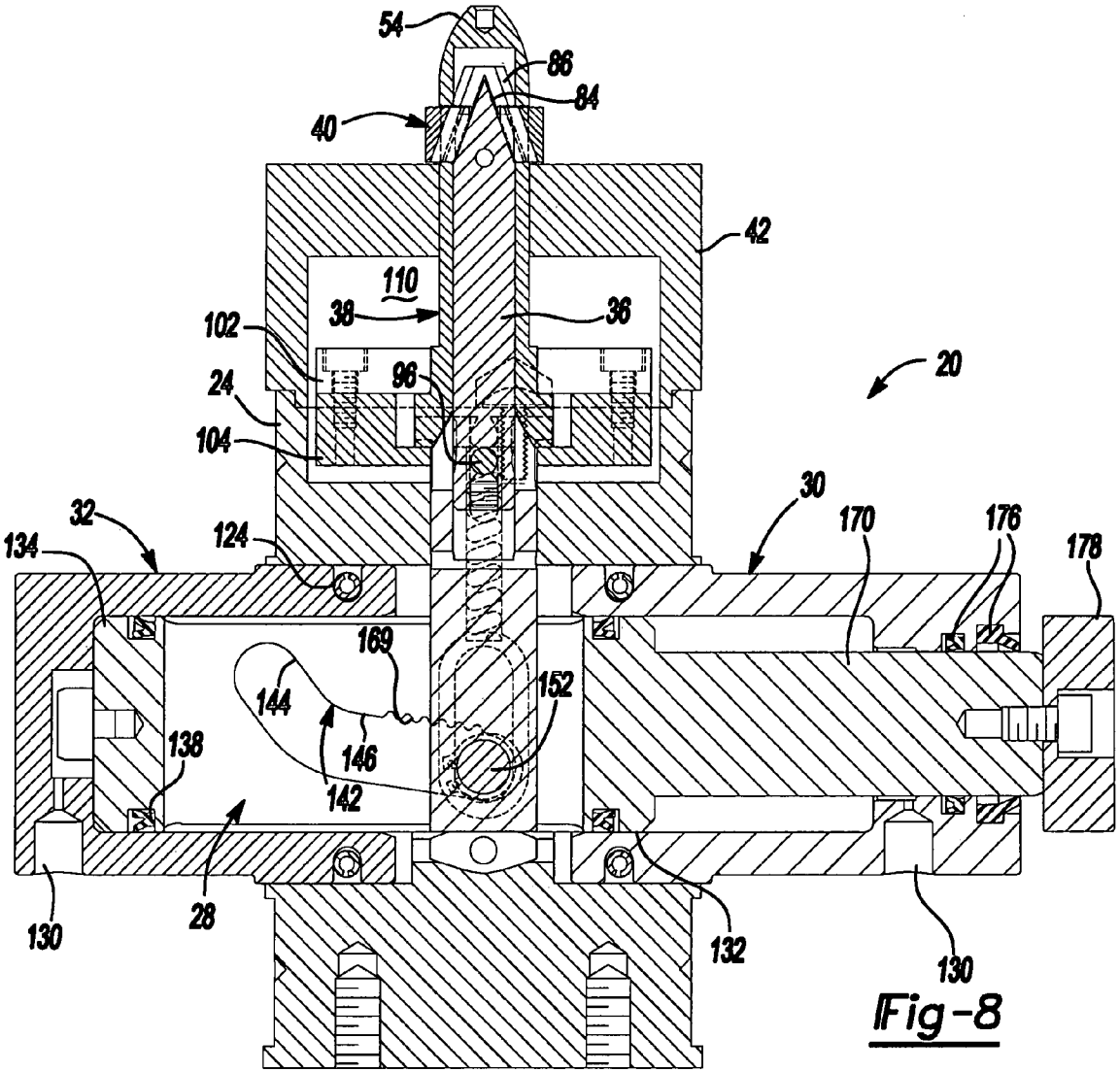
FIG. 8 is a cross-sectional view, like that of FIGS. 4 and 6, showing the first embodiment sealed locking pin locator clamp in a clamped position.
Figure 9:
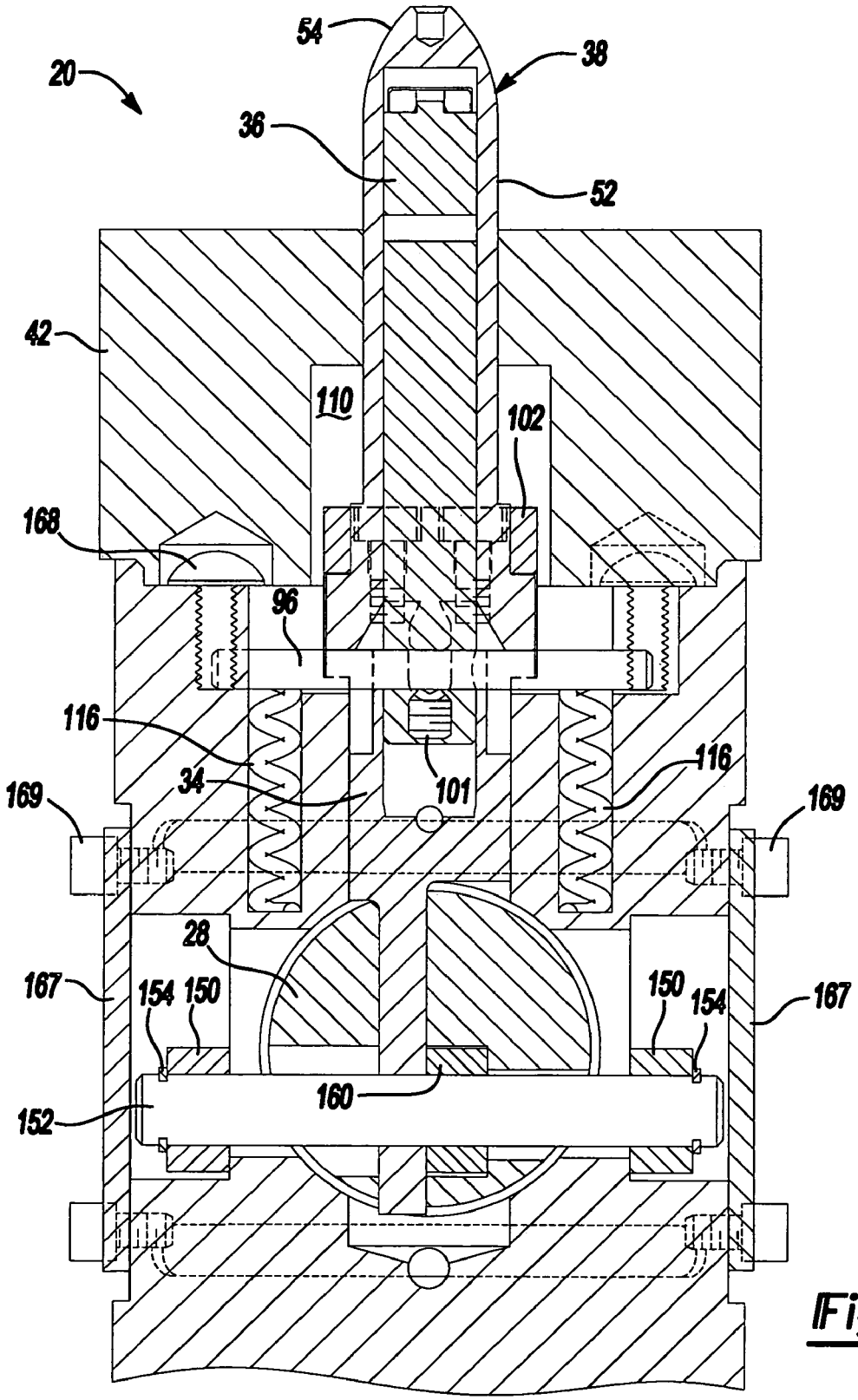
FIG. 9 is a cross-sectional view, like that of FIGS. 5 and 7, showing the first embodiment sealed locking pin locator clamp in a clamped position.

In the clamping position shown in FIGS. 8 and 9, middle roller 160 engages a corresponding detent 169 formed along camming surface 146. Specifically, camming surface 146 has slight indentations or detents 169 where cam rollers 160 find a locking position which prevents unlocking even under vibration when fluid pressure is lost or undesirably reduced. Piston 28 is retracted by applying fluid pressure against the opposite piston head portion 134 to provide a reversal of the above-discussed motions.

An extension portion 170 is coupled to one end of piston 28 and extends through an aperture 172 extending through an end wall 174 of first piston cylinder 30. A pair of seals 176 engage extension portion 170 and first piston cylinder 30 to restrict ingress of contamination and egress of pressurized fluid. A knob 178 is coupled to an end of extension portion 170. If pressurized fluid is unavailable, a user may cause clamp 20 to function as previously described by simply grasping knob 178 and imparting a force sufficient to slide piston 28 as previously described. If a manual override feature is not desired, piston 28 may be configured without extension portion 170 without departing from the scope of the present invention.

Furthermore, the foregoing discussion discloses and describes merely exemplary embodiments of the present invention. One skilled in the art will readily recognize from such discussion, and from the accompanying drawings and claims, that various changes, modifications and variations may be made therein without department from the spirit and scope of the invention as defined in the following claims.

What is claimed is:

1. A clamp comprising:

a piston head operably advancing in a first linear direction;

a clamp body;

a driving member coupled to the piston head, the driving member being moveable in the first direction in concert with the piston head, the driving member being moveable at least partially inside the body;

a workpiece-locating pin movably coupled to the driving member, the workpiece-locating pin being moveable in a second direction substantially perpendicular to the first direction when moving from a first position to a second position, the workpiece-locating pin at least partially externally projecting from the body; and a clamping member movably coupled to the driving member, the clamping member being moveable relative to the workpiece-locating pin in the first direction when moving from a retracted position to a clamping position.

2. The clamp of claim 1 further including a first camming surface operably controlling at least a portion of the movement of the workpiece-locating pin relative to the driving member.

3. The clamp of claim 2 further including a second camming surface operably controlling at least a portion of the movement of the clamping member relative to the workpiece-locating pin.

4. The clamp of claim 3 wherein the first camming surface is located on the driving member.

5. The clamp of claim 4 wherein the second camming surface is located on a control member moveably coupled to the driving member, the control member being moveable along the second direction.

6. The clamp of claim 5 wherein the control member is at least partially slidably positioned within a cavity formed within the workpiece-locating pin.

7. The clamp of claim 6 wherein the control member and the workpiece-locating pin translate together during a portion of the stroke of the workpiece-locating pin and travel relative to one another during a second portion of the stroke of the workpiece-locating pin.

8. The clamp of claim 7 wherein the clamping member is positioned beneath an outer surface of the workpiece-locating pin during a portion of the movement of the workpiece-locating pin and where the clamping member extends beyond the outer surface of the workpiece-locating pin during another portion of the movement of the workpiece-locating pin.

9. The clamp of claim 1 further including a second clamping member movably coupled to the driving member, the second clamping member being moveable relative to the workpiece-locating pin in a direction opposite to the first direction when moving from a retracted position to a clamping position.

10. A clamp comprising:

a piston head operably advancing in a first linear direction;

a clamp body;

a driving member coupled to the piston head, the driving member being moveable in the first direction in concert with the piston head, the driving member being moveable at least partially inside the body;

a workpiece-locating pin movably coupled to the driving member, the workpiece-locating pin being moveable in a second direction substantially perpendicular to the first direction when moving between an extended position and a retracted position, the workpiece-locating pin partially projecting from the body;

a control member at least partially slidably positioned within the body, the control member being moveable in the second direction; and a clamping member movably coupled to the control member where relative movement between the control member and the workpiece-locating pin causes the clamping member to move between a retracted position and a clamping position.

11. The clamp of claim 10 wherein the control member and the workpiece-locating pin translate along a common axis.

12. The clamp of claim 11 wherein the control member is slidably positioned within a cavity formed in the workpiece-locating pin.

13. The clamp of claim 12 wherein the control member includes a camming surface engaging the clamping member.

14. The clamp of claim 13 wherein the control member includes a rail slidably positioned within a groove of the clamping member, the camming surface of the control member being operable to move the clamping member toward the clamping position and the rail being operable to move the clamping member toward the retracted position.

15. The clamp of claim 10 further including an anvil coupled to the clamp body, the anvil including an aperture in receipt of the workpiece-locating pin.

16. The clamp of claim 15 further including a second anvil and a second workpiece-locating pin having a diameter greater than the workpiece-locating pin, the second anvil and second workpiece-locating pin being operable to replace the anvil and workpiece-locating pin.

17. A clamp comprising:

a clamp body;

a driving member being moveable in a first linear direction, the driving member being moveable at least partially inside the body;

a workpiece-locating pin movably coupled to the driving member, the workpiece-locating pin being moveable in a second direction substantially perpendicular to the first direction when moving from a first position to a second position, the workpiece-locating pin at least partially externally projecting from the body; and a clamping member movably coupled to the driving member, the clamping member being moveable relative to the workpiece-locating pin in the first direction when moving from a retracted position to a clamping position.

18. The clamp of claim 17 further including a control member at least partially slidably positioned within the body, the control member being moveable in the second direction where relative movement between the control member and the workpiece-locating pin causes the clamping member to move between a retracted position and a clamping position.

19. The clamp of claim 18 wherein the clamping member is positioned beneath an outer surface of the workpiece-locating pin when in the retracted position, the clamping member extending beyond the outer surface of the workpiece-locating pin when in the clamping position.

20. The clamp of claim 19 wherein the control member is biased toward a first position, the clamping member being moveable between the retracted position and the clamping position when the control member is in the first position.

21. The clamp of claim 20 wherein the clamping member is located at the clamping position when the control member is translated away from the first position.

22. The clamp of claim 21 wherein the driving member includes a camming surface operably controlling at least a portion of the movement of the workpiece-locating pin relative to the driving member.

23. A method for locating and clamping a workpiece in a predetermined location with a clamp having a locating pin, a clamping member and a driving member, the method comprising:

positioning the locating pin in an extended position;

positioning the clamping member in a retracted position;

linearly translating the driving member along in a first direction;

linearly translating the locating pin along in a second direction substantially perpendicular to the first direction; and moving the clamping member in the first direction from the retracted position to a clamping position.

24. The method of claim 23 further including biasing the clamping member toward the retracted position.

25. The method of claim 24 further including moving a control member relative to the locating pin to move the clamping member between the retracted and clamping positions.

26. The method of claim 25 further including moving the locating pin and the control member along a common axis.

* * * * *